US009494376B2

(12) United States Patent
Wolf

(10) Patent No.: US 9,494,376 B2
(45) Date of Patent: Nov. 15, 2016

(54) FIRING PIN ASSEMBLY

(71) Applicant: ZEV Technologies, Inc., Oxnard, CA (US)

(72) Inventor: Alec Daniel Wolf, Newbury Park, CA (US)

(73) Assignee: ZEV Technologies, Inc., Oxnard, CA (US)

( * ) Notice: Subject to any disclaimer, the term of this patent is extended or adjusted under 35 U.S.C. 154(b) by 0 days.

(21) Appl. No.: 15/019,796

(22) Filed: Feb. 9, 2016

(65) Prior Publication Data

US 2016/0231075 A1 Aug. 11, 2016

Related U.S. Application Data

(60) Provisional application No. 62/113,987, filed on Feb. 9, 2015.

(51) Int. Cl.
*F41A 19/29* (2006.01)

(52) U.S. Cl.
CPC ..... *F41A 19/29* (2013.01)

(58) Field of Classification Search
CPC ..... F41A 19/13; F41A 19/29
USPC ..... 42/69.01, 69.02, 70.08
See application file for complete search history.

(56) References Cited

U.S. PATENT DOCUMENTS 5,537,769 A * 7/1996 Hargraves ..... F41A 19/13 42/69.01

* cited by examiner

*Primary Examiner* — Reginald Tillman, Jr.
(74) *Attorney, Agent, or Firm* — Knobbe Martens Olson & Bear LLP

(57) ABSTRACT

A firing pin assembly for a firearm having an engagement surface that has a channel in an engagement surface with a trigger bar to reduce frictional engagement with a trigger assembly. The firing pin assembly also includes chamfers to reduce weight and an elongated firing pin end piece.

29 Claims, 2 Drawing Sheets

FIRING PIN ASSEMBLY

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND OF THE INVENTION

1. Field of the Invention

The present invention relates to firing pin assemblies and, in particular, includes a firing pin that permits a smoother and lighter trigger pull.

2. Description of the Related Art

Firing pins are formed in firearms to strike the primer of cartridges to cause the cartridges to fire. Firing pin assemblies are often spring loaded so as to be biased in a firing orientation. Typically, the firing pins are restrained from firing by components of a trigger assembly such as a trigger bar. When the trigger is pulled, the trigger bar is moved so as to permit the spring loaded firing pin to move forward and strike the primer of the cartridge.

The force of the spring that biases the firing pin can affect the amount of force needed to be exerted on the trigger to release the firing pin. The spring has to be sufficiently strong to permit the firing pin to fire the cartridge but should also not be so strong so as to cause the shooter to have to exert excessive force to fire the firearm as this may result in the firearm being jostled by the trigger pull thereby reducing the accuracy of the firearm.

Further, the engagement between the trigger assembly and the firing pin assembly may also result in inaccuracies. If the trigger assembly binds or is otherwise inhibited from disengaging with the firing pin assembly, this may retard the activation of the firing pin assembly which can induce malfunctions that negatively also affect the performance of the firearm.

Hence, there is a need for improved firing pin assemblies and, in particular, firing pin and trigger assemblies that permit easier trigger pulls and easier release of the firing pin by the trigger assembly.

SUMMARY OF THE INVENTION

The aforementioned needs are satisfied in one embodiment by a firearm comprising: a frame; a barrel positioned adjacent the frame; a receiver that houses a firing chamber and a firing pin assembly which includes a firing pin member having a vertically extending flange wherein the firing pin assembly is spring biased towards a firing position; a trigger assembly having a trigger and a trigger bar member that engages with the vertically extending flange of the firing pin member to inhibit the spring biased firing pin member from moving to the firing position and wherein activation of the trigger assembly disengages the trigger bar member from the flange resulting in the firing pin member moving into the firing position wherein an engagement surface of the flange that engages with the trigger bar member includes a channel to reduce the frictional engagement between the flange member and the trigger bar member.

The aforementioned needs are also satisfied in another embodiment by a firearm comprising: a frame; a barrel positioned adjacent the frame; a receiver that houses a firing chamber and a firing pin assembly which includes a firing pin member having a vertically extending flange wherein the firing pin assembly is spring biased towards a firing position wherein the vertical flange includes a rear surface that includes chamfer to reduce the weight of the firing pin member; a trigger assembly having a trigger and a trigger bar member that engages with the vertically extending flange of the firing pin member to inhibit the spring biased firing pin member from moving to the firing position and wherein activation of the trigger assembly disengages the trigger bar member from the flange resulting in the firing pin member moving into the firing position.

These and other objects and advantages will become more apparent from the following description taken in conjunction with the accompanying drawings.

DETAILED DESCRIPTION OF THE PREFERRED EMBODIMENT

Figure 1:
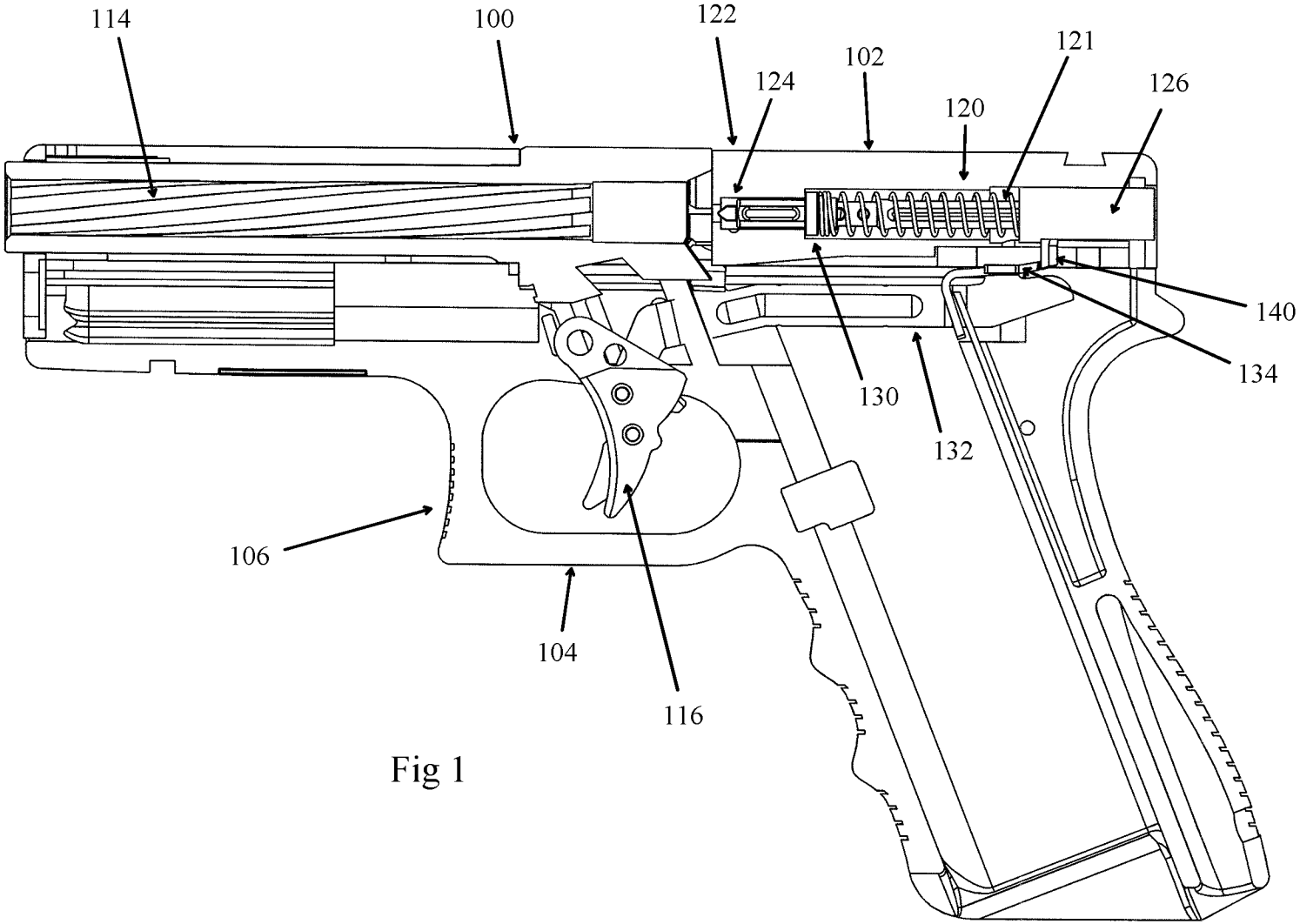
FIG. 1 is a cross-sectional view of a firearm having one embodiment of an improved firing pin assembly and trigger assembly.

Reference will now be made to the drawings wherein like numerals refer to like parts throughout. FIG. 1 illustrates an exemplary firearm 100 such as a semiautomatic pistol that incorporates an exemplary embodiment of an improved firing pin assembly 102. As shown, the firearm 100 includes a trigger assembly 104 that includes a trigger that the user depresses to fire the firearm. As will be discussed in greater detail below, the firing pin assembly 102 includes a firing pin member 120 that is spring biased towards a firing chamber 112 of the firearm 100 by a spring 121. The trigger assembly 104 engages with the firing pin assembly 102 such that depression of the trigger 114 induces the firing pin member 120 to be urged towards the firing chamber 112 thereby striking the primer of a cartridge positioned in the chamber 112 causing the cartridge to fire which results in the slug or bullet of the cartridge travelling down the barrel 114 and outward towards a target.

The firearm 100 in this embodiment, includes a frame 106 that has a slide 122 that houses the barrel 114, the firing chamber 112 and the trigger assembly 104. The frame 106 may also include a magazine 110 that houses additional cartridges. In operation, once the firearm 100 is fired, the firing pin assembly 112 returns to a cocked position and is held in place by the trigger assembly 104. The slide 122 traverses backwards and the barrel pivots to receive an additional cartridge into the firing chamber 112. The slide 122 then traverses forward into the position shown in FIG. 1 when the firearm 100 is ready to fire an additional round. The firearm 100 may comprise a firearm that operates in the manner of a Glock™ type firearm that is known in the art.

As shown, the spring 121 buts up against a rear component 126 of the firing chamber and a flange 130 on the firing pin member 120. The trigger assembly 104 includes the trigger 116 and an interconnecting piece 132 and a trigger bar 134. The trigger bar 134 has a horizontally extending piece that engages with a front surface 142 of a flange 140 that extends downward from the firing pin member 120. The trigger assembly 106 operates to depress the trigger bar 134 downwardly to disengage the trigger bar 134 from the flange 140 thereby inducing the spring 121 to propel the firing pin 120 forward to strike the primer of the cartridge in the firing chamber 112 firing the firearm 100.

As discussed above, the strength of the spring 121 that biases the firing pin member 120 forward affects the amount of pressure that has to be exerted on the trigger 116 to discharge the firearm. A lower force spring allows for the trigger assembly 104 to fire the firearm with less pressure, however, the lower force of the spring results in less force being applied to the firing pin member 120 which can reduce the force with which the primer of the cartridge is struck. To address this, the Applicant has configured the firing pin member 120 to be lighter weight and has further configured a contact surface 124 to provide for greater deformation of the primer to facilitate firing of the firearm.

FIGS. 2A-2E are views of the firing pin member 120 that has been adapted to facilitate the use of a lower spring constant spring and also to improve the engagement and disengagement between the trigger bar 134 and the firing pin member 120. The firing pin member includes a central shaft 150 that has a front surface 152 and a rear surface 154. The flange 140 is attached or formed onto the rear surface 154 and the contact surface 124 of the firing pin member 120 is positioned on the front surface 152. The central shaft defines a spring mounting location where the spring 121 is positioned in the manner shown in FIG. 1. The central shaft 150 also includes a plurality of longitudinal indentations 160 that reduce the weight of the firing pin member 120. In one implementation the rear longitudinal indentations 160 have a depth of 0.039 inches and extend 0.820 inches. The central shaft also includes a central section 162 that has a plurality of round indentations 164 that also reduce the weight of the member 120 that have a radius of 0.153 inches. In one embodiment, the firing pin member 120 is 2.185 inches long, the rear portion is 1.155 inches, the central portion is 0.477 inches and the front section is 0.432 inches and the member 120 has a general radius of 0.188 inches in the rear portion and 0.153 inches in the middle section.

The rear flange 140 has a rear or back surface 144 that, in one embodiment, has chamfers formed on the lower portions of the flange 140. The chamfers 172 in one implementation are 0.250 inches long and 0.125 inches thick and are formed at a 45 degree angle with an outer depth of 0.045 inches. For further weight reduction, a channel 170 is formed between the chamfers 172 and the channel 170 extends the entire length of the flange 140. The channel 170 can have a depth of 0.020 inches.

The chamfers 172, the longitudinal indentations 160 and the round indentations or through holes 164 all contribute to a reduction of the weight of the firing pin member 120. For example, a stock firing pin used in Glock™ pistols has a weight of approximately 7.4 grams, however, one specific embodiment of the Applicant's firing pin member can have a weight of 5.8 grams which is more than a 20% reduction.

The front surface 142 of the flange 140 also has a channel 176 formed therein. The channel 176 is formed so as to be centered and to extend approximately 0.193 of the 0.250 inches of the length of the flange 140. The channel 176 is approximately a third of the width of the front surface of the flange 140 or 0.048 inches in one non-limiting embodiment. As a portion of the front surface 142 of the flange member 140 has been removed, the frictional engagement between the flange 140 and the trigger bar 134 is reduced. This reduction in frictional engagement allows for easier activation of the trigger assembly 104 which allows for smoother operation of the trigger assembly 104 and therefore more accuracy in shooting.

Further, the reduction in weight of the firing pin member 120 means that a softer firing pin spring 121 can be used. In typical Glock™ applications, the firing pin spring is a 5 pound spring, whereas the Applicant's design for a similar application can use a 2 pound spring which results in a lighter trigger pull and greater accuracy.

Figure 2C:
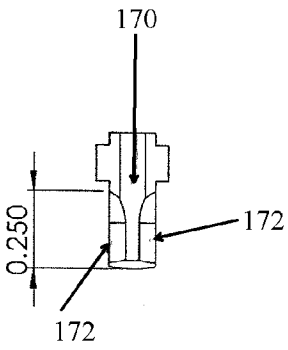
FIGS. 2C-2F are front, back, rear and detailed views of the firing pin assembly of FIG. 1.
Figure 2A:
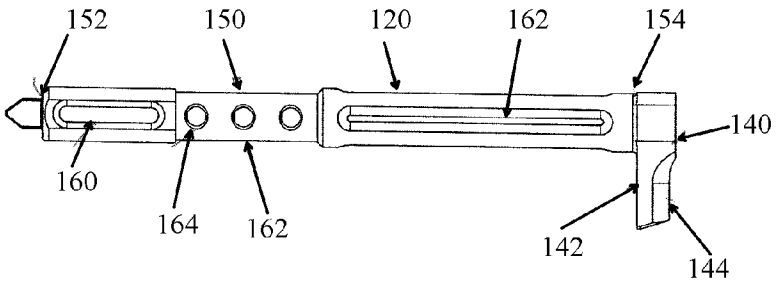
FIGS. 2A and 2B are front and top views of the firing pin assembly of FIG. 1.
Figure 2B:
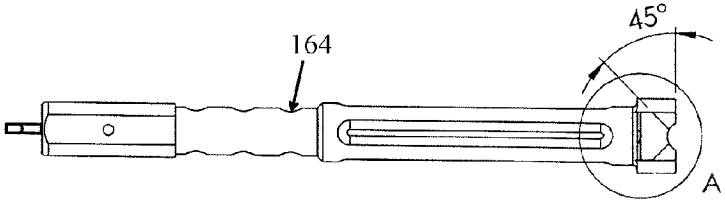
Figure 2F:
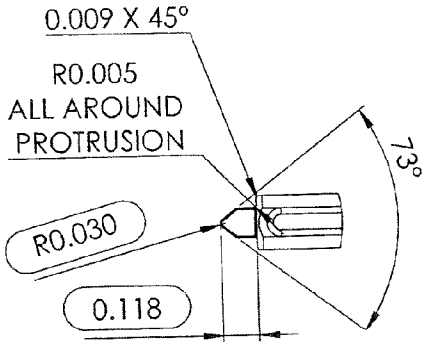
Figure 2D:
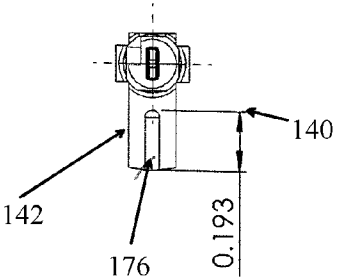
Figure 2E:
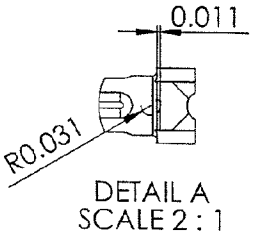

In order to ensure that the primers are fired with the firing pin assembly 102, a firing pin end piece 180 is elongated and increased in depth as is shown in FIGS. 2D and 2F. More specifically, the firing pin end piece 180 is one implementation, has a greater height than width as opposed to being a round firing pin. In one specific implementation, the firing pin is 0.033 inches wide but is 0.104 inches in height. The end of the firing pin end piece 180 forms a point having an approximately radius of 0.030 inches with an angle of approximately 73 degrees and extends outward 0.118 inches in the manner shown in FIG. 2A however, the elongate height of the firing pin results in greater deformation of the primer which provides greater assurance that the firing pin will detonate the primer by deforming a sufficient area of the primer outer wall to cause the primer to fire.

It will be appreciated that all of the dimensions given in this application and incorporated by reference from the parent provisional application are approximate and exemplary. It will further be appreciated that various changes, substitutions and modifications to the form, use and implementation of the embodiments described herein may be made by those skilled in the art without departing from the spirit or scope of the present invention. As such, the present invention should not be limited to the foregoing discussion but should be defined by the appended claims.

What is claimed is:

1. A firearm comprising:
a frame;
a barrel positioned adjacent the frame;
a receiver that houses a firing chamber and a firing pin assembly which includes a firing pin member having a vertically extending flange wherein the firing pin assembly is spring biased towards a firing position;
a trigger assembly having a trigger and a trigger bar member that engages with the vertically extending flange of the firing pin member to inhibit the spring biased firing pin member from moving to the firing position and wherein activation of the trigger assembly disengages the trigger bar member from the flange resulting in the firing pin member moving into the firing position wherein an engagement surface of the flange that engages with the trigger bar member includes a channel to reduce the frictional engagement between the flange member and the trigger bar member.

2. The firearm of claim 1, wherein the channel extends in a direction that is the direction that the trigger bar moved to release the firing pin member.

3. The firearm of claim 2, wherein the channel forms a recessed surface that is approximately ⅓ of the width of a front surface of the vertically extending flange.

4. The firearm of claim 1, wherein the vertical flange includes a rear surface that includes chamfer to reduce the weight of the firing pin member.

5. The firearm of claim 4, wherein the chamfers are formed so as to be separated by a channel that further reduces the weight of the firing pin member.

6. The firearm of claim 5, wherein the firing pin member includes a firing pin end piece that has a first dimension that is greater than the second dimension.

7. The firearm of claim 6, wherein the height of the firing pin end piece is approximately 3 times greater than the width of the firing pin end piece.

8. The firearm of claim 7, wherein the firing pin end piece is pointed.

9. The firearm of claim 1, wherein the firing pin member includes a seating portion to receive a spring that biases the firing pin member in the direction of the firing chamber, a forward portion and a central portion interposed between the seating portion and the forward portion.

10. The firearm of claim 9, wherein elongate grooves are formed in the seating portions and the forward portion and the central portion includes a plurality of through holes to reduce the weight of the firing pin member.

11. A firearm comprising: a frame;

a barrel positioned adjacent the frame;

a receiver that houses a firing chamber and a firing pin assembly which includes a firing pin member having a vertically extending flange wherein the firing pin assembly is spring biased towards a firing position wherein the vertical flange includes a rear surface that includes chamfer to reduce the weight of the firing pin member;

a trigger assembly having a trigger and a trigger bar member that engages with the vertically extending flange of the firing pin member to inhibit the spring biased firing pin member from moving to the firing position and wherein activation of the trigger assembly disengages the trigger bar member from the flange resulting in the firing pin member moving into the firing position, wherein an engagement surface of the flange that engages with the trigger bar member includes a channel to reduce the frictional engagement between the flange member and the trigger bar member.

12. The firearm of claim 11, wherein the channel extends in a direction that is the direction that the trigger bar moved to release the firing pin member.

13. The firearm of claim 12, wherein the channel forms a recessed surface that is approximately ⅓ of the width of a front surface of the vertically extending flange.

14. The firearm of claim 11, wherein the chamfers are formed so as to be separated by a channel that further reduces the weight of the firing pin member.

15. The firearm of claim 14, wherein the firing pin member includes a firing pin end piece that has a first dimension that is greater than the second dimension.

16. The firearm of claim 15, wherein the height of the firing pin end piece is approximately 3 times greater than the width of the firing pin end piece.

17. The firearm of claim 16, wherein the firing pin end piece is pointed.

18. The firearm of claim 11, wherein the firing pin member includes a seating portion to receive a spring that biases the firing pin member in the direction of the firing chamber, a forward portion and a central portion interposed between the seating portion and the forward portion.

19. The firearm of claim 18, wherein elongate grooves are formed in the seating portions and the forward portion and the central portion includes a plurality of through holes to reduce the weight of the firing pin member.

20. A firing pin assembly for a firearm that includes a frame, a barrel positioned adjacent the frame; a receiver that houses a firing chamber and the firing pin assembly, the firing pin assembly comprising:

a firing pin member;

a spring biasing towards a firing pin member towards a firing position; and a vertically extending flange that is sized so that the trigger assembly has a bar that engages with the vertically extending flange to inhibit the spring biased firing pin member from moving to the firing position and wherein activation of the trigger assembly disengages the trigger bar member from the flange resulting in the firing pin member moving into the firing position wherein the flange has an engagement surface of the flange that engages with the trigger bar member includes a channel to reduce the frictional engagement between the flange member and the trigger bar member.

21. The firing pin assembly of claim 20, wherein the channel extends in a direction that is the direction that the trigger bar moved to release the firing pin member.

22. The firing pin assembly claim 21, wherein the channel forms a recessed surface that is approximately ⅓ of the width of a front surface of the vertically extending flange.

23. The firing pin assembly of claim 20, wherein the vertical flange includes a rear surface that includes chamfer to reduce the weight of the firing pin member.

24. The firing pin assembly of claim 23, wherein the chamfers are formed so as to be separated by a channel that further reduces the weight of the firing pin member.

25. The firing pin assembly of claim 24, wherein the firing pin member includes a firing pin end piece that has a first dimension that is greater than the second dimension.

26. The firing pin assembly of claim 25, wherein the height of the firing pin end piece is approximately 3 times greater than the width of the firing pin end piece.

27. The firing pin assembly of claim 26, wherein the firing pin end piece is pointed.

28. The firing pin assembly of claim 20, wherein the firing pin member includes a seating portion to receive a spring that biases the firing pin member in the direction of the firing chamber, a forward portion and a central portion interposed between the seating portion and the forward portion.

29. The firing pin assembly of claim 28, wherein elongate grooves are formed in the seating portions and the forward portion and the central portion includes a plurality of through holes to reduce the weight of the firing pin member.

* * * * *